US008302394B2

(12) United States Patent
Ochi

(10) Patent No.: US 8,302,394 B2
(45) Date of Patent: Nov. 6, 2012

(54) FLUID PRESSURE UNIT

(75) Inventor: Yoshiyuki Ochi, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 941 days.

(21) Appl. No.: 12/377,099

(22) PCT Filed: Jun. 2, 2008

(86) PCT No.: PCT/JP2008/001392

§ 371 (c)(1),
(2), (4) Date: Feb. 10, 2009

(87) PCT Pub. No.: WO2008/149541

PCT Pub. Date: Dec. 11, 2008

(65) Prior Publication Data

US 2010/0154398 A1 Jun. 24, 2010

(30) Foreign Application Priority Data

Jun. 7, 2007 (JP) ..... 2007-151952

(51) Int. Cl.
*F16D 31/02* (2006.01)

(52) U.S. Cl. ..... 60/403

(58) Field of Classification Search ..... 60/403, 60/404

See application file for complete search history.

(56) References Cited

U.S. PATENT DOCUMENTS

| | | | | |
|---|---|---|---|---|
| 4,326,558 | A * | 4/1982 | Gage | 60/404 |
| 5,664,937 | A | 9/1997 | Takahashi et al. | |
| 5,720,598 | A | 2/1998 | de Chizzelle | |
| 5,748,077 | A | 5/1998 | Brandt | |
| 6,834,739 | B2 | 12/2004 | Iyoda et al. | |
| 7,610,754 | B2 | 11/2009 | Ochi et al. | |
| 2003/0221674 | A1 | 12/2003 | Scanderbeg et al. | |

FOREIGN PATENT DOCUMENTS

| | | | |
|---|---|---|---|
| DE | 202005007955 | U1 | 11/2005 |
| GB | 895485 | | 5/1962 |
| JP | 48-041303 | A | 6/1973 |
| JP | 51-109391 | A | 9/1976 |
| JP | 57-159981 | | 10/1982 |
| JP | 61-204986 | A | 12/1986 |
| JP | 10-299664 | | 11/1998 |
| JP | 2000-274378 | A | 10/2000 |
| JP | 2003-172115 | A | 6/2003 |
| JP | 2006-214510 | A | 8/2006 |
| JP | 2006-299939 | A | 11/2006 |
| KR | 10-2007-0026862 | A | 3/2007 |
| WO | WO 2004/072485 | A1 | 8/2004 |
| WO | WO 2006/112721 | A1 | 10/2006 |

* cited by examiner

*Primary Examiner* — F. Daniel Lopez
(74) *Attorney, Agent, or Firm* — Birch, Stewart, Kolasch & Birch, LLP.

(57) ABSTRACT

A pressure sensor (17) is provided for detecting the discharge pressure of a hydraulic pump (11). An abnormality detection section (23) of a controller (21) detects a dry operation of the hydraulic pump (11) when the discharge pressure detected by the pressure sensor (17) becomes equal to or lower than a judgment reference pressure determined in advance according to the driving rotation speed of the hydraulic pump (11).

3 Claims, 2 Drawing Sheets

FLUID PRESSURE UNIT

TECHNICAL FIELD

The present invention relates to fluid pressure units, and particularly relates to measures to prevent a dry operation of a fluid pressure pump.

BACKGROUND ART

Conventionally, fluid pressure units have been known that drive an actuator by pumping fluid by a fluid pressure pump. As a fluid pressure unit of this kind, for example, Patent Document 1 discloses a hydraulic power unit. This hydraulic power unit includes a hydraulic pump as a fluid pressure pump, a hydraulic cylinder as an actuator, and a tank. The hydraulic pump is driven by a variable-speed motor to suck working oil from the tank and to pump it to the hydraulic cylinder. Whereby, the hydraulic cylinder is driven.

In the above hydraulic power unit, level lowering of the working oil in the tank may cause the hydraulic pump to suck air together with the working oil. Air can be mixed with the working oil by some other factors, which may also cause the hydraulic pump to suck the air. When the hydraulic pump is kept being driven in this state, namely, when the hydraulic pump continues a generally-called dry operation, the hydraulic pump may fall in a lubrication insufficient state to cause seizing.

To tackle this problem, it can be considered to apply dry operation detection means as disclosed in, for example, Patent Document 2 to the hydraulic power unit.

Specifically, a control device for an engine in Patent Document 2 includes a sensor for detecting the pressure of lubricant oil supplied by a lubricant pump to the engine. The lubricant pump is connected to the crank shaft of the engine through a pulley belt to be driven. Accordingly, as the engine speed is increased, the rotation speed of the lubricant pump increases to increase the pressure of the lubricant oil inside the engine. When a state that the engine speed is equal to or higher than a predetermined value while the pressure of the lubricant oil is lower than a reference pressure continues for a predetermined time period, the control device stops the engine or lowers the engine speed. Whereby, the dry operation of the engine is detected to lead to prevention of the engine seizing. Specifically, the state that the pressure of the lubricant oil is low while on the other hand the engine speed is high means that the supply amount of the lubricant oil is insufficient and lubrication insufficiency is caused. Therefore, this state is detected.

In the case where this dry operation detection control is applied to the aforementioned hydraulic power unit, when the rotation speed and the discharge pressure of the hydraulic pump fall within the hatched range in FIG. 4 (a range equal to or higher than the predetermined rotation speed and equal to or lower than the predetermined pressure), the hydraulic pump is stopped or lowered in its rotation speed. In other words, according to this state, in which the discharge pressure of the hydraulic pump is excessively low, while on the other hand the rotation speed of the hydraulic pump is high, it is detected that that the amount of the working oil sucked is insufficient and the hydraulic pump is in the dry operation state.

Patent Document 1: Japanese Unexamined Patent Application Publication 2006-214510

Patent Document 2: Japanese Unexamined Patent Application Publication 2003-172115

DISCLOSURE OF THE INVENTION

Problems that the Invention is to Solve

However, mere application of the detection means in Patent Document 2 to the hydraulic power unit in Patent Document 1 cannot secure definite detection of the dry operation of the hydraulic pump. Specifically, in the state where the hydraulic pump is driven at a rotation speed lower than the predetermined value shown in FIG. 4, even if air is mixed with the working oil to allow the discharge pressure to become lower than the predetermined pressure, the rotation speed may be equal to or lower than the predetermined value. In this state, the dry operation cannot be detected. Therefore, seizing in the hydraulic pump cannot be prevented practically, with a result that the reliability lowers.

The present invention has been made in view of the foregoing, and its objective is to definitely prevent, in a fluid pressure unit including a fluid pressure pump for pumping fluid to a fluid pressure actuator, the dry operation of the fluid pressure pump which is caused due to insufficiency of the amount of fluid sucked.

Means for Solving the Problems

A first aspect of the present invention is directed to a fluid pressure unit including a fluid tank (16), a fluid pressure pump (11) sucking fluid from the fluid tank (16) and discharging it, and a fluid pressure actuator (13) driven by supplying thereto the fluid discharged from the hydraulic pump (11). In the present aspect, the fluid pressure unit further includes: pressure detection means (17) for detecting a discharge pressure of the fluid pressure pump (11); and abnormality detection means (23) for detecting operation abnormality of the fluid pressure pump (11) when the pressure detected by the pressure detection means (17) becomes equal to or lower than a preset pressure determined in advance according to a driving rotation speed of the hydraulic pump (11).

In the above aspect, when the amount of the fluid in the tank (16) is reduced, for example, the fluid pressure pump (11) may suck air. Air suction may cause remarkable lowering of the discharge pressure of the fluid pressure pump (11). In other words, the fluid pressure pump (11) is in a generally-called dry operation state. Continuation of driving of the fluid pressure pump (11) in this state may lead to seizing in the fluid pressure pump (11).

However, in the present aspect, when the discharge pressure of the fluid pressure pump (11) lowers to be equal to or lower than the preset pressure determined according to the driving rotation speed of the fluid pressure pump (11), this state is detected as the dry operation of the fluid pressure pump (11). The preset pressure is determined according to the driving rotation speed of the fluid pressure pump (11), specifically, is set over the entire operation range of the fluid pressure pump (11). Accordingly, even when the fluid pressure pump (11) is driven in any rotation speed range, the operation abnormality of the fluid pressure pump (11) can be detected definitely. Upon detection of the operation abnormality, the fluid pressure pump (11) can be stopped or lowered in its rotation speed.

Referring to a second aspect of the present invention, in the first aspect, the preset pressure is determined at a pressure of loss of the fluid occurring in a supply pipe from the fluid pressure pump (11) to the fluid pressure actuator (13).

In the above aspect, the preset pressure is set at the pressure of the loss of the fluid which is possible to occur in the supply pipe. Specifically, the preset pressure is set at the lowest pressure (discharge pressure) reachable according to the driving rotation speed of the fluid pressure pump (11) in the normal operation of the fluid pressure pump (11). In this aspect, when the discharge pressure becomes equal to or lower than the lowest pressure, the abnormal operation of the fluid pressure pump (11) is detected.

Referring to a third aspect of the present invention, in the second aspect, the preset pressure is determined at a pressure of loss of the fluid occurring in a supply pipe from the fluid pressure pump (11) to the fluid pressure actuator (13).

In the above aspect, the preset pressure and driving rotation speed of the fluid pressure pump (11) fall in direct proportion to each other. Specifically, as the driving rotation speed of the fluid pressure pump (11) is increased, the flow rate in the supply pipe increases to increase the loss of the pressure in the supply pipe.

Referring to a fourth aspect of the present invention, in the first or second aspect, the fluid pressure pump (11) is a hydraulic pump, and the fluid pressure actuator (13) is a hydraulic cylinder.

In the above aspect, supply of the working oil from the hydraulic pump (11) causes the hydraulic cylinder (13) to stretch or contract. In the present aspect, the dry operation of the hydraulic pump (11) is detected.

Referring to a fifth aspect of the present invention, in the fourth aspect, the fluid pressure actuator (13) is composed to drive a chuck of a machine tool.

In the above aspect, the operation of the hydraulic cylinder (13) makes opening and closing of the chuck.

Advantages of the Invention

As described above, the present invention is so composed that when the discharge pressure of the fluid pressure pump (11) becomes equal to or lower than the preset pressure determined in advance according to the driving rotation speed of the fluid pressure pump (11), the dry operation of the fluid pressure pump (11) is detected. This enables definite detection in an early stage of the dry operation regardless of the driving rotation speed of the fluid pressure pump (11). Hence, if the fluid pressure pump (11) is arranged to be stopped or so upon detection of the dry operation, seizing in the fluid pressure pump (11) can be prevented definitely. This can lead to increased reliability of the hydraulic power unit (10).

In the second aspect of the present invention, the pressure of the loss of the fluid, which is possible to occur depending on the driving rotation speed of the fluid pressure pump (11) in the supply pipe from the fluid pressure pump (11) to the fluid pressure actuator (13), is set as the judgment reference pressure. In other words, the reachable lowest pressure of the fluid pressure pump (11) in the normal operation is set as the preset pressure. Hence, the dry operation of the fluid pressure pump (11) can be detected further definitely.

INDEX OF REFERENCE NUMERALS

10 hydraulic power unit (fluid pressure unit)
11 hydraulic pump (fluid pressure pump)
13 hydraulic cylinder (fluid pressure actuator)
16 fluid tank (tank)
17 pressure sensor (pressure detection means)
23 abnormality detection section (abnormality detection means)

BEST MODE FOR CARRYING OUT THE INVENTION

Embodiments of the present invention will be described below in detail with reference to the accompanying drawings.

Figure 1:
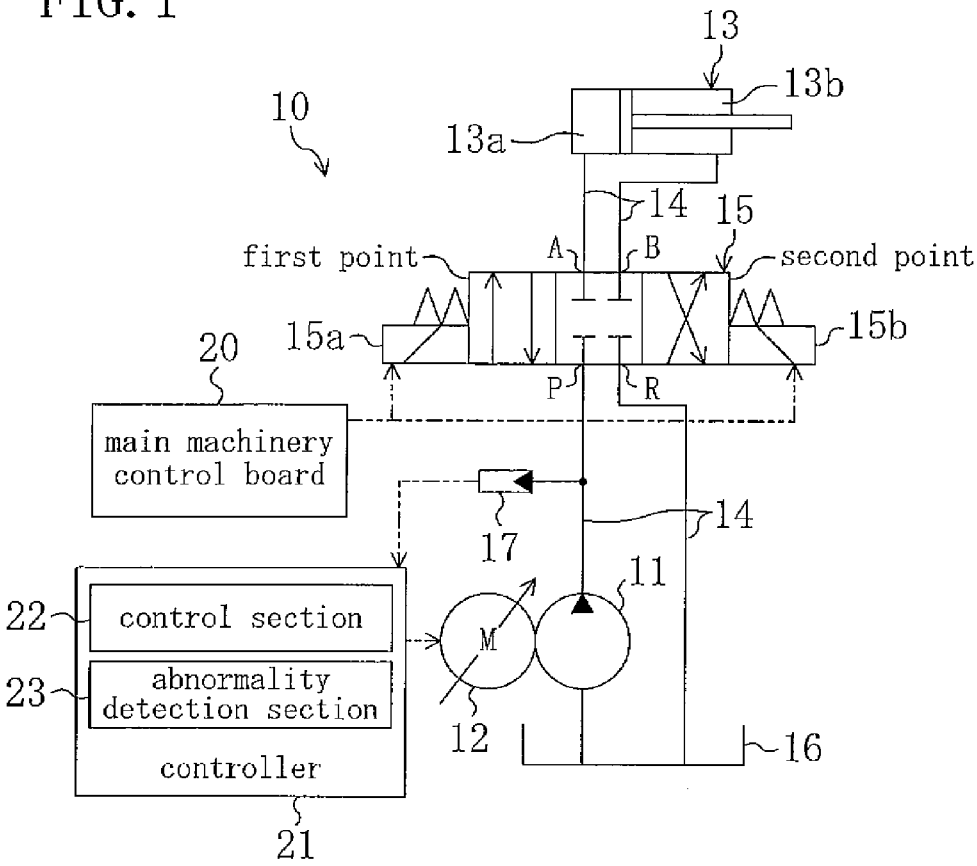
FIG. 1 is a hydraulic circuit diagram showing an overall construction of a hydraulic power unit in accordance with an embodiment of the present invention.

As shown in FIG. 1, a hydraulic power unit (10) in the present embodiment composes a fluid pressure unit in accordance with the present invention. The hydraulic power unit (10) is used as a main machinery of a machine tool, such as a machining center or the like. The machine tool includes, though not shown, a plurality of fixing devices (targets to be driven) for fixing a workpiece or a tool, such as chucks, tail stock clamps, cutter holder clamps, or the like. These fixing devices are driven by an actuator of the hydraulic power unit (10). Herein, the case where the actuator drives a chuck for chucking a workpiece is described, but the same operation and control can be performed in driving tail stock clumps or the like.

The hydraulic power unit (10) includes a hydraulic pump (11), a motor (12), a hydraulic cylinder (13), a direction switching valve (15), a fluid tank (16), a main machinery control board (20), and a controller (21).

The hydraulic pump (11) composes a fluid pressure pump for sucking from the fluid tank (16) and discharging working oil as a fluid. The hydraulic pump (11) may be composed of, for example, a fixed displacement type pump, such as a gear pump, a trochoid pump, a vane pump, a piston pump, or the like.

The motor (12) is a variable speed motor for driving the hydraulic pump (11). The motor (12) includes inside thereof a rotation speed control encoder (not shown) that detects the rotation speed corresponding to the discharge amount of the hydraulic pump (11).

The hydraulic cylinder (13) drives the chuck of the machine tool, and serves as a fluid pressure actuator driven by supply of the working oil discharged from the hydraulic pump (11). The hydraulic cylinder (13) includes a head chamber (13*a*) and a rod chamber (13*b*) which are defined by a piston. When the working oil is supplied to the head chamber (13*a*), the hydraulic cylinder (13) stretches to close the chuck. In reverse, when the working oil is supplied to the rod chamber (13*b*), the hydraulic cylinder (13) contracts to open the chuck.

The head chamber (13*a*) and rod chamber (13*b*) of the hydraulic cylinder (13), the discharge side of the hydraulic pump (11), and the fluid tank (16) are connected to each other through hydraulic pipes (14).

The direction switching valve (15) is provided in the middle of the hydraulic pipes (14), and is arranged to switch the hydraulic pipes (14) between a communication state and a shut-up state. The direction switching valve (15) is a four-port three-point spring centered solenoid switching valve including first and second solenoids (15*a*, 15*b*). Referring to the four ports of the direction switching valve (15), an A port, a B port, a P port, and an R port communicate through the hydraulic pipes (14) with the head chamber (13*a*) of the hydraulic cylinder (13), the rod chamber (13*b*) of the hydraulic cylinder (13), the discharge side of the hydraulic pump (11), and the fluid tank (16), respectively.

The direction switching valve (15) is switchable among an intermediate point, a first point, and a second point by ON/OFF operation of the respective solenoids (15*a*, 15*b*). Setting of the direction switching valve (15) at the intermediate point allows all the four ports to be in a shut-up state. Setting thereof at the first point allows the P port and the A port to communicate with each other while allowing the B port and the R port to communicate with each other. Setting thereof at the second point allows the P port and the B port to communicate with each other while allowing the A port and the R port to communicate with each other.

In a hydraulic pipe (14) on the discharge side of the hydraulic pump (11), a pressure sensor (17) as pressure detection means is provided for detecting the discharge pressure of the hydraulic pump (11), that is, the pressure of the working oil discharged.

The main machinery control board (20) controls the machine tool, and operates the chuck by switching and controlling the direction switching valve (15). Specifically, the main machinery control board (20) drives and controls each solenoid (15*a*, 15*b*) of the direction switching valve (15) according to the processing proceeding state. By the main machinery control board (20), the direction switching valve (15) is accordingly switched to any of the points (the intermediate point, the first point, or the second point).

The controller (21) includes a control section (22) and the abnormality detection section (23). The controller (21) receives an output signal from the pressure sensor (17). The controller (21) is arranged to be capable of detecting the current rotation speed of the operating motor (12), that is, the driving rotation speed of the hydraulic pump (11).

Figure 3:
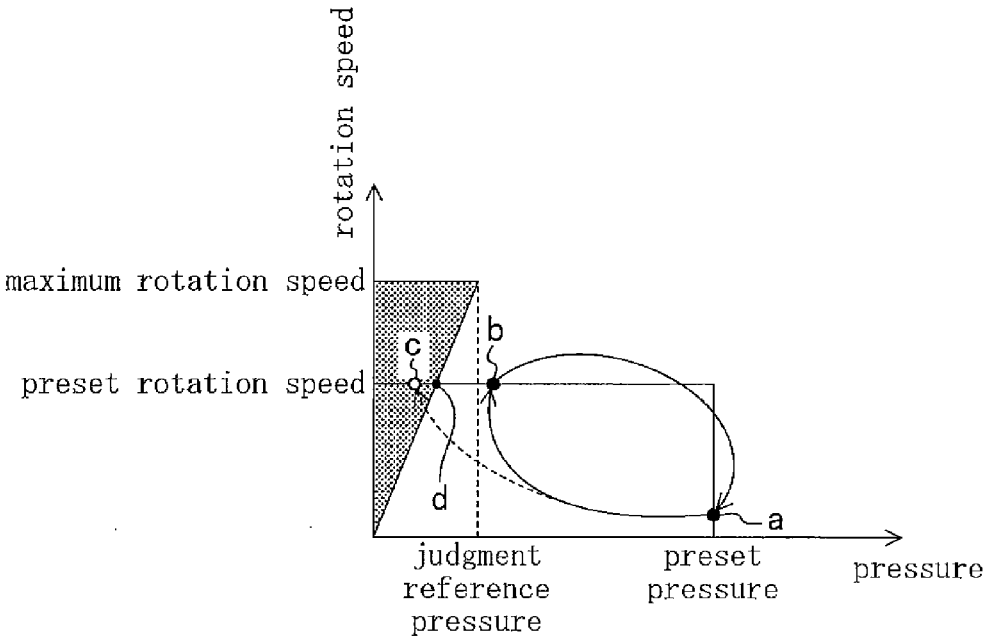
FIG. 3 is a graph indicating variations in driving rotation speed and discharge pressure of the hydraulic pump under control in an embodiment of the present invention.
Figure 4:
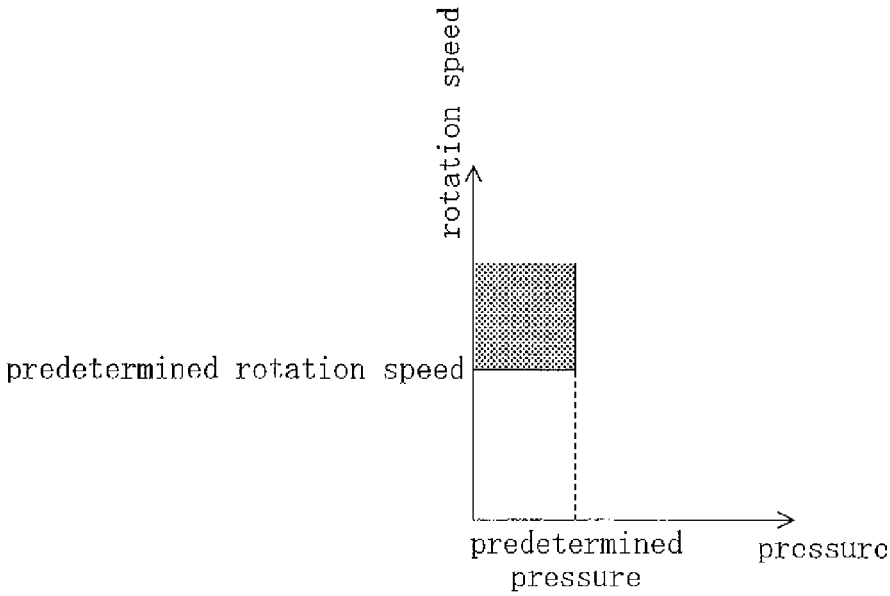
FIG. 4 is a graph showing a relationship between the engine speed and a preset pressure of lubricant oil in a conventional ease.

The control section (22) drives and controls the motor (12) according to the load state so that the current rotation speed of the operating motor (12) and the pressure detected by the pressure sensor (17) are on lines drawing at a preset rotation speed and a preset pressure, respectively (see FIG. 3).

The abnormality detection section (23) is arranged to detect operation abnormality of the hydraulic pump (11) when the pressure detected by the pressure sensor (17) becomes equal to or lower than a judgment reference pressure determined according to the current rotation speed of the operating motor (12). Namely, the judgment reference pressure is the preset pressure according to the present invention, which is determined in advance according to the driving rotation speed of the hydraulic pump (11) for judging whether or not the hydraulic pump (11) is in the dry operation state. Hereinafter, the judgment reference pressure may be referred to as a dry operation judgment reference pressure.

Figure 2:
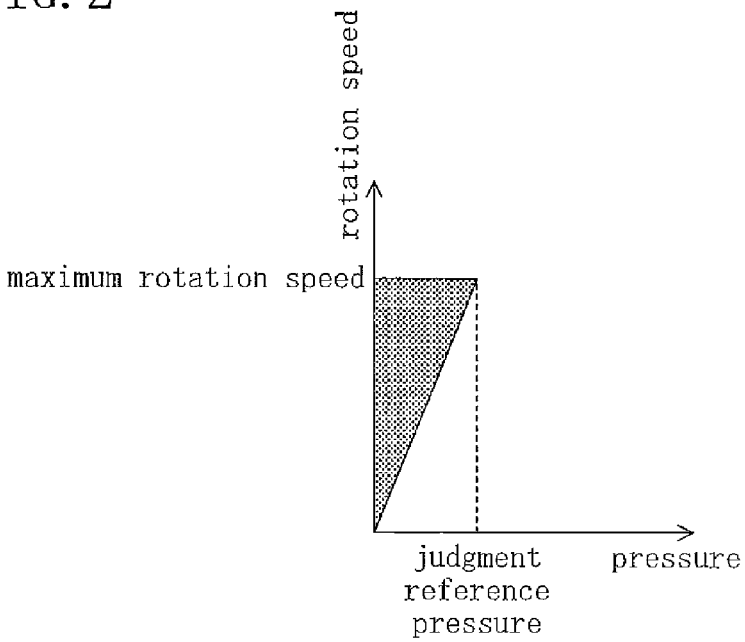
FIG. 2 is a graph showing a relationship between the driving rotation speed of a hydraulic pump and a judgment reference pressure in an embodiment of the present invention.

As shown in FIG. 2, the dry operation judgment reference pressure is determined over the range from zero to the maximum of the rotation speed of the motor (12), and increases in proportion to the driving rotation speed. The range not exceeding the dry operation judgment reference pressure (a dotted triangular region in FIG. 2) serves as an operation abnormality range. The maximum rotation speed is a maximum rotation speed that the motor (12), i.e., the hydraulic pump (11) is reachable. The dry operation judgment reference pressure is set at a value of pressure loss of the working oil caused in the hydraulic pipes (14), i.e., supply pipes from the discharge side of the hydraulic pump (11) to the respective chambers (13*a*, 13*b*) of the hydraulic cylinder (13). The pressure loss is in proportion to the current rotation speed of the operating motor (12), i.e., the flow rate of the working oil. In other words, the dry operation judgment reference pressure is set at the lowest pressure (discharge pressure) according to the driving rotation speed of the hydraulic pump (11) which is reachable where the hydraulic pump (11) is driven normally.

When the hydraulic pump (11) sucks air together with the working oil, namely, when the hydraulic pump (11) is in the dry operation state because of the amount of the sucked working oil being insufficient, the discharge pressure of the hydraulic pump (11) lowers remarkably. Accordingly, lowering of the discharge pressure to be equal to or lower than the judgment reference pressure can result in detection of the dry operation (operation abnormality) of the hydraulic pump (11). Upon detection of the dry operation by the abnormality detection section (23), the control section (22) stops the motor (12) or lowers the driving rotation speed thereof.

-Control Operation by Controller-

A control operation by the controller (21) will be described specifically with reference to FIG. 3. Herein, an example is described in which the chuck of the machine tool is allowed to be close to fix (grasp) a workpiece or the like and to be opened to release the workpiece or the like.

The control section (22) of the controller (21) drives and controls the motor (12) so that the discharge pressure and driving rotation speed of the hydraulic pump (11) are the previously determined preset pressure and rotation speed, respectively. Suppose first that at the point a in FIG. 3, the chuck is closed to fix a workpiece. In this state, the direction switching valve (15) is switched at the second point to allow the working oil to be supplied from the hydraulic pump (11) to the head chamber (13*a*) of the hydraulic cylinder (13). In this state, the driving rotation speed of the hydraulic pump (11) is far lower than the preset rotation speed, while the discharge pressure is kept at the preset pressure.

Next, for releasing the workpiece by allowing the chuck to be opened in the above state, the direction switching valve (15) is switched first to the second point to allow the working oil to be supplied from the hydraulic pump (11) to the rod chamber (13*b*) of the hydraulic cylinder (13). This allows the hydraulic cylinder (13) to start contracting.

Immediately after the hydraulic cylinder (13) starts contracting, in other words, when the chuck starts being opened, the discharge pressure of the hydraulic pump (11) abruptly lowers. Then, as the chuck is opened, the discharge pressure of the hydraulic pump (11) lowers, while the driving rotation speed of the hydraulic pump (11) abruptly increases up to the preset rotation speed (a point b in FIG. 3). At the point b, the discharge pressure of the hydraulic pump (11) is higher than the dry operation judgment reference pressure (a point d in FIG. 3) corresponding to the preset rotation speed. In other words, the hydraulic pump (11) performs the discharging operation normally.

When the chuck is opened fully, the state returns to the point a in FIG. 3 again. Specifically, when the chuck is opened fully, the discharge pressure of the hydraulic pump (11), which abruptly increases, is controlled to be the preset pressure. Hence, the hydraulic pump (11) is driven at the lowest rotation speed far lower than the preset rotation speed (the point a in FIG. 3).

Herein, in transition from the point a to the point b in FIG. 3, namely, in the process of opening the chuck, if, for example, the level of the working oil in the fluid tank (16) is remarkably low, the hydraulic pump (11) may suck air together with the working oil. In such a case, the discharge pressure of the hydraulic pump (11) remarkable lowers when compared with that in the normal operation. Then, when the driving rotation speed of the hydraulic pump (11) reaches the preset rotation speed, the discharge pressure of the hydraulic pump (11) may become equal to or lower than the dry operation judgment reference pressure (the point c in FIG. 3). This state is detected by the abnormality detection section (23) as the dry operation of the hydraulic pump (11) to allow the control section (22) to stop the motor (12) or to lower in its rotation speed. This can lead to prevention of seizing caused due to the dry operation of the hydraulic pump (11).

-Advantages of Embodiment-

In the present embodiment, the dry operation judgment reference pressure according to the driving rotation speed is set to range from zero to the maximum of the driving rotation speed, and the dry operation (operation abnormality) is judged when the discharge pressure of the hydraulic pump (11) becomes equal to or lower than the judgment reference pressure. Accordingly, even if the hydraulic pump (11) is driven in any rotation speed range, the dry operation of the hydraulic pump (11), that is, the discharge pressure lowering caused due to air suction (air mixing) by the hydraulic pump (11) can be detected definitely. This can definitely prevent seizing in the hydraulic pump (11) caused due to air mixing. Hence, the reliability of the hydraulic power unit (10) can be improved.

In the present embodiment, the pressure of the loss of the working oil, which is possible to occur depending on the driving rotation speed of the hydraulic pump (11) in the hydraulic pipes (14) from the hydraulic pump (11) to the hydraulic cylinder (13), is set as the judgment reference pressure. In other words, the lowest discharge pressure reachable where the hydraulic pump (11) is driven normally is set as the judgment reference pressure. Hence, even in the state where the discharge pressure of the hydraulic pump (11) is equal to or lower than the judgment reference pressure, the dry operation of the hydraulic pump (11) can be detected further definitely.

Since the lowest discharge pressure reachable according to the driving rotation speed is set as the judgment reference pressure, stable detection of the dry operation can be realized when compared with the conventional case. Specifically, in the case where the detection range is set in a range equal to or higher than a predetermined rotation speed and equal to or lower than a predetermined pressure as in the conventional case, since the discharge pressure of the hydraulic pump (11) may be unstable in a comparatively high rotation speed range, the hydraulic pump (11) not in the abnormal operation (dry operation) may fall into the detection range to cause erroneous detection. In contrast, in the present invention, the range equal to or lower than the lowest pressure reachable according to the driving rotation speed is set as the detection range, with a result that lowering of the discharge pressure caused due to the abnormal operation (the dry operation) can be detected stably.

Further, the present embodiment enables detection of not only level lowering of the working oil in the fluid tank (16) and lowering of the discharge pressure of the hydraulic pump (11) caused due to air mixing with the working oil itself but also viscosity lowering of the working oil caused due to mixing of liquid coolant or the like with the working oil. Specifically, when the viscosity of the working oil becomes lower than the normal level, the pressure is difficult to increase. This remarkably lowers the discharge pressure of the hydraulic pump (11).

<Other Embodiments>

The above embodiment may employ any of the following configurations.

In the above embodiment, the judgment reference pressure determined according to the driving rotation speed ranges from zero to the maximum driving rotation speed, for example, but the present invention is not limited thereto. The judgment reference pressure may range in any rotation speed range in which the hydraulic pump (11) is operable within the range between zero and the maximum rotation speed.

The hydraulic cylinder (13) is used as a fluid pressure actuator in the above embodiment, but the present invention can employ any other one of hydraulic actuators and fluid pressure actuators, of course.

The present invention is applicable to devices other than the machine tool and fluid power units using fluid other than the working oil.

The above embodiment describes the hydraulic power unit (10) including the fluid tank (16), but the present invention is applicable to a circulation circuit including a fluid pressure pump circulating working oil or water between objects. In other words, in any devices including a fluid pressure pump sucking and discharging working oil or the like, the discharge pressure of the fluid pressure pump lowers upon mixing of air with the working oil or the like regardless of with or without the fluid tank (16) and the like, and accordingly, such dry operation can be detected.

The above embodiments are mere essentially preferable examples, and are not intended to limit the scopes of the present invention, applicable subjects, and uses.

Industrial Applicability

As described above, the present invention is useful in fluid pressure units including a fluid pressure pump discharging fluid and supplying it to an actuator.

The invention claimed is:

1. A fluid pressure unit comprising:

a fluid tank;

a fluid pressure pump sucking fluid from the fluid tank and discharging it;

a fluid pressure actuator driven by the fluid discharged from the fluid pressure pump;

a pressure sensor that detects discharge pressure of the fluid pressure pump; and abnormality detector that detects abnormal operation of the fluid pressure pump when the detected discharge pressure is equal to or lower than a preset pressure, the preset pressure increasing in proportion to a driving rotation speed of the fluid pressure pump, wherein the preset pressure is determined at a pressure of loss of the fluid occurring in a supply pipe from the fluid pressure pump to the fluid pressure actuator.

2. The fluid pressure unit of claim 1, wherein the fluid pressure pump is a hydraulic pump, and the fluid pressure actuator is a hydraulic cylinder.

3. The fluid pressure unit of claim 2, wherein the fluid pressure actuator is composed to drive a chuck of a machine tool.

* * * * *